US005893226A

United States Patent [19]

Sophocleous et al.

[11] Patent Number: 5,893,226

[45] Date of Patent: Apr. 13, 1999

[54] ASSISTANCE SUMMONING DEVICE

[76] Inventors: Sophocles S. Sophocleous; Teresa Sophocleous, both of 6122 W. Chennault, Fresno, Calif. 93722

[21] Appl. No.: 08/963,837

[22] Filed: Nov. 4, 1997

[51] Int. Cl.[6] ..... G09F 17/00

[52] U.S. Cl. ..... 40/591; 40/603

[58] Field of Search ..... 24/68 CD, 69 CT, 24/265 H; 40/591, 603, 604; 248/634, 499; 441/89, 125

[56] References Cited

U.S. PATENT DOCUMENTS

| | | | |
|---|---|---|---|
| 2,620,579 | 12/1952 | Dienes | 40/591 |
| 3,701,210 | 10/1972 | Smith | 40/591 |
| 3,763,585 | 10/1973 | Mosch | 40/591 |
| 3,949,503 | 4/1976 | Waress | 40/591 |
| 4,471,873 | 9/1984 | Thomas | 40/591 X |
| 4,906,503 | 3/1990 | De La Cruz | 40/603 X |
| 5,016,372 | 5/1991 | Gold | 40/591 |
| 5,071,181 | 12/1991 | Wagner | 248/499 X |
| 5,245,943 | 9/1993 | Hull et al. | 441/89 X |
| 5,398,437 | 3/1995 | Bump, Jr. et al. | 40/591 X |
| 5,423,644 | 6/1995 | First, Sr. | 24/68 CD |
| 5,533,287 | 7/1996 | Cole | 40/591 |

FOREIGN PATENT DOCUMENTS 1284113 of 0000 United Kingdom .

2260214 7/1993 United Kingdom .

*Primary Examiner*—Joanne Silbermann

*Attorney, Agent, or Firm*—W. D. English; Milord Keshishzadeh, J.D.

[57] ABSTRACT

An easy to install, reliable, and portable assistance summoning device that displays a need for assistance through interchangeable reflective symbols and letters, and more particularly to a banner like device that is temporarily attachable to vehicles such as cars, trucks, motorcycles, boats, campers, and aircraft. The banner like device is made of a light weight, flexible, and foldable sheet of material to allow compact storage of the device. The sheet of material having at least two support rods to maintain the banner in an unfurled position. The support rods may also be made of magnetic material to allow attachment of said banner to metallic surfaces. Each support rod having a durable elastic band attached to each respective end thereof, whereby said elastic bands may be attached to protruding elements of a surface to maintain the device in an extended position. At least a pair of adjustable cords, each cord being attached to the elastic band at one end, and each cord having a latching means at the opposite end, whereby said latching means are attached to certain objects to maintain said banner in an unfurled position. Each cord also having an adjusting means to control the length of said cord to maintain the banner in a taut position.

19 Claims, 3 Drawing Sheets

ASSISTANCE SUMMONING DEVICE

FIELD OF INVENTION

The present invention relates to a portable assistance summoning device, and more particularly to a banner like device with attachable messages thereon which is attached to a vehicle through either a magnetic option, an elastic option, or a hook mechanism option. The different attaching options may be either used independently or in unison to ensure secure and reliable attachment.

DISCUSSION OF THE PRIOR ART

Although signs for use with vehicles have been known for many years, they have been too cumbersome to attach, prone to failure, and the attaching cords have been susceptible to entanglement. Therefore, there is still a long standing need for an improved assistance summoning device to be attached to vehicles that is easy to attach, is easily portable without being prone to entanglement, that has several methods and positions of attachment to ensure against failure, and is buoyant to allow use with nautical vehicles.

For example, U.S. Pat. No. 3,763,585, issued to Mosch, discloses a banner like warning device that is attachable to a vehicle. However, Mosch's invention is limited in its manner of attachment and the number of objects to which it may attach. Mosch only provides a hook mechanism to attach the device to a vehicle; thereby, making it susceptible to failure in adverse weather conditions such as high winds.

U.S. Pat. No. 5,016,372, issued to Gold, discloses a road service sign into which a car antennae is inserted. However, the size of the sign is finite because of limitations of weight on a car's antennae. Passing motorists may not see the small sign and fail to offer assistance. Furthermore, the sign cannot be securely attached to allow maximum visibility and is also susceptible to failure in adverse weather conditions.

Another patent, U.S. Pat. No. 5,398,437 to Bump, Jr. et al. discloses a banner like warning device that primarily uses magnets to attach the banner to a vehicle. However, some vehicles are non-metallic and will not accommodate the invention. Even though Bump's invention incorporates apertures for insertion of rope as an attachment method, it would be both time consuming and cumbersome to install especially when time is of the essence in an emergency situation.

U.S. Pat. No. 5,533,287 to Cole, discloses a sign for stranded vehicles that has stiff rods on its perimeter thus preventing it from being folded or folled away for storage. Therefore, it is limited in size because of the storage space needed. In addition, Cole's invention has long elastic cords that are susceptible to entanglement during storage. Furthermore, the invention only utilizes hooks for attachment thus making it susceptible to failure if the hooks are detached in adverse weather.

In view of the prior at, there remains a long standing and continuing need for an advance in the art beyond the existing art of assistance summoning devices that is simpler and economical in design and more easy and reliable in use.

OBJECTS OF THE INVENTION

It is, accordingly, an object of the present invention is to overcome disadvantages of the prior art and more particularly, it is an object of this invention to provide an improved assistance summoning device that is easy to attach to any vehicle in several positions to allow maximum visibility.

Another object of the invention is to provide an improved assistance summoning device that has several mechanisms of attachment that may be used either independently or in conjunction with each other to ensure against failure in adverse weather conditions.

Another object of the invention is to provide an improved assistance summoning device that is easily portable and storable without being prone to entanglement.

Another object of the invention is to provide an improved assistance summoning device that is buoyant thereby allowing use in nautical vehicles.

A further object of the invention is to provide an improved assistance summoning device that is quickly and easily attachable where time is of the essence.

A still further object of the invention is to provide an improved assistance summoning device where the message is easily interchangeable to summon the particular type of assistance needed.

Another object of the invention is to provide a road assistance banner that can carry independent messages on each side, front and rear, of the banner.

A still further object of the invention is to provide an improved assistance summoning device that is economically efficient to produce and use, and that may be used for commercial advertising purposes as well as for emergency road assistance.

Other objects, advantages, and novel features of the invention will become more readily apparent from the following detailed description of the invention when considered in the light of the accompanying drawings and appended claims.

DETAILED DESCRIPTION OF THE PREFERRED EMBODIMENT

The following is a description of the best mode of implementing the concept of the invention. This description is given only to illustrate the general principles of the invention and is not to be interpreted in a limiting sense. The true scope and further extent of the invention can only be ascertained by reading the appended claims.

Figure 1:
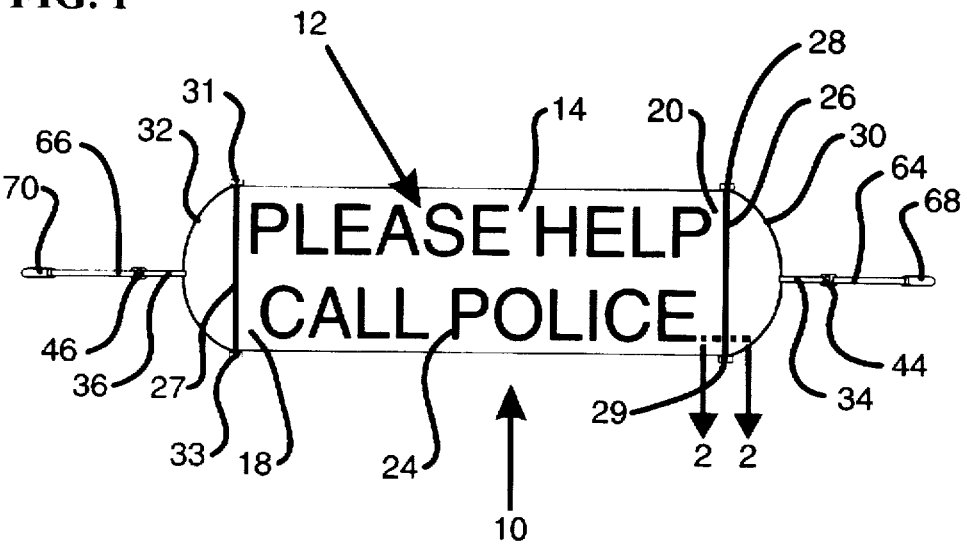
FIG. 1 is an elevational view of the assistance summoning device in an unfurled position.

FIG. 1 illustrates an improved assistance summoning device 10 in an unrolled position prior to attachment to a vehicle, wherein applied reference numerals indicate parts similarly hereinafter identified. Device 10 consists of a sheet-like material 12 that may be of any known shape such as, but not limited to, circular, square, hexagonal, octagonal, triangular, or rectangular; however, it is preferably rectangular. Material 12 is preferably made of any non-reflective, flexible, foldable, light-weight material that is water-proof, buoyant, heat resistant, and/or wind resistant. For example, material 12 may be made of, but not limited to, vinyl, nylon mesh, or cotton.

Material 12 has an outer surface 22 to which suitable symbols 24 with messages of caution, need for assistance, or advertising may be affixed. Symbols 24 may be removably attached to accommodate an appropriate assistance message that a stranded motorist would like to convey. Symbols 24 are preferably made of a reflective material to allow maximum visibility even in inadequate luminous conditions. Symbols 24 are attached to material 12 by any conventional means such as, but not limited to, silk-screen, gluing, sewing on, painting on, or using a hook and loop means commercially known as VELCRO®.

Figure 2:
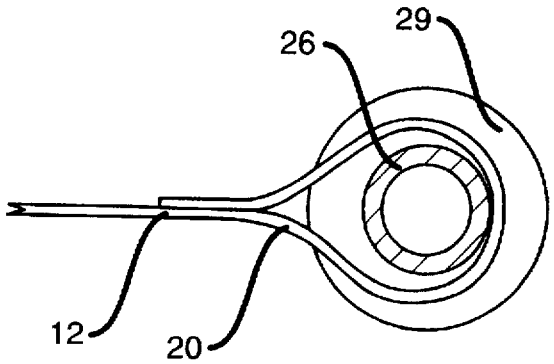
FIG. 2 is a cross section of the assistance summoning device taken along line 2—2 of FIG. 1, showing vertical member contained within banner material.

Material 12 has a top edge 14, a bottom edge 16, a first edge 18, and a second edge 20. First edge 18 and said second edge 20 respectively contain similar vertical members 26 and 27. FIG. 2 presents a more clear illustration of said second edge 20 being folded back on itself to create a sleeve, through which one vertical member 26 is inserted. Vertical members 26 and 27 are made of a substantially rigid material to maintain said material 12 in an unfurled position to allow reading of the message. Vertical members 26 and 27 may be made of, but are not limited to, plastic, metal, or wood. Preferably, vertical members 26 and 27 are made of a magnetic material that may independently affix device 10 to metallic materials.

Figure 3:
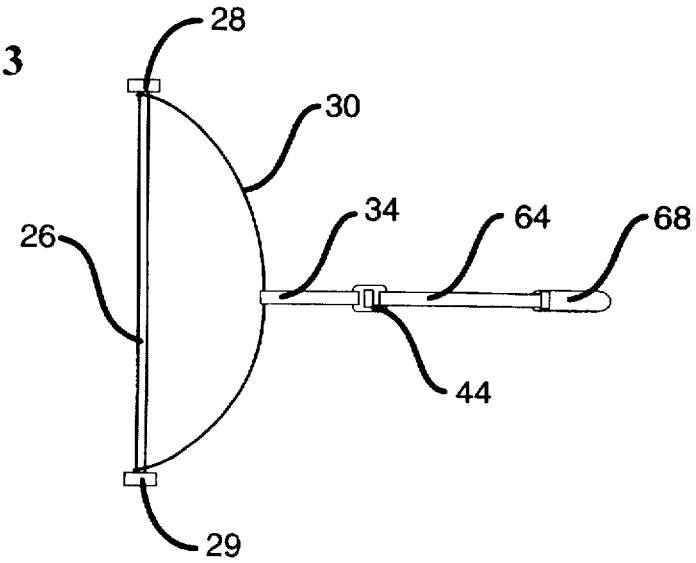
FIG. 3 is a fragmental elevational view showing the right side of the invention.

Referring to FIGS. 1 and 3, vertical members 26 and 27 have attached to the respective ends thereof respective end caps 28, 29, 31, 33 which prevent the sleeve of material 12 from slipping off of said vertical members 26 and 27. Vertical members 26 and 27 also have attached to the ends thereof respective end portions of elastic band sections 30 and 32 in the manner of elastic cords. Elastic band sections 30 and 32 may be attached to protrusions on a vehicle to maintain said material 12 in an unfurled position. Preferably, elastic band sections 30 and 32 may be attached to respective end portions 40 and 41 of a bumper 43 attached to a car 42, as illustrated in FIG. 4.

Referring to FIGS. 1 and 3, elastic band sections 30 and 32 have attached thereto respective end portions of cords 34 and 36. Cords 34 and 36 are preferably made of nylon straps similar to materials used in seat belts. Respective opposite end portions of cords 34 and 36 are attached to respective identical adjusting means 44 and 46. Identical adjusting means 44 and 46 are more clearly illustrated in a detailed view in FIG. 5. The adjusting means description for element 44 is likewise applicable to adjusting means 46. Adjusting means 44 has a first buckle portion 48, said first buckle portion 48 having a bar 50 to which cord 34 attaches. First buckle portion 48 attaches to a middle portion 52 containing a manipulable clamping means 54 thereon. A spring biasing means 56 is contained between middle portion 52 and clamping means 54, whereby biasing means 56 maintains said clamping means 54 in a binding position. Application of force to a left end 58 of clamping means 54 releases said clamping means 54 from a bound position. A right end 60 of clamping means 54, having a serrated edge 61, applies force to a loop portion 62 which extends from middle portion 52 of adjusting means 44.

Figure 5:
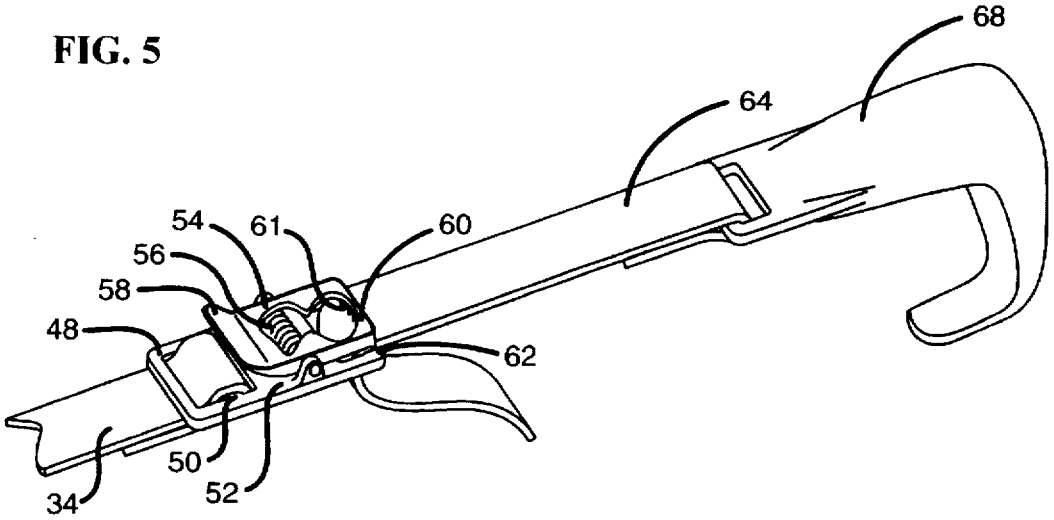
FIG. 5 is a detailed and close up perspective view of adjusting means containing an adjustable cord therein.

Referring to FIGS. 1, 3, and 5, loop portion 62 and right end 60 of adjusting means 44 and 46 have inserted there between respective adjustable cords 64 and 66. Adjustable cords 64 and 66 are preferably made of nylon straps similar to material used in seat belts. Respective end portions of adjustable cords 64 and 66 have attached thereto respective hook mechanisms 68 and 70 for releasable fixing to sections of vehicles. As can be seen more clearly in FIG. 5, the length of adjustable cord 64 is controlled by adjusting means 44. Force is applied to left end 58 of clamping means 54, whereby right end 60 releases its grasp of adjustable cord 64. Cord 64 can now be pulled through or reinserted into loop portion 62 to allow taut attachment of hook 68 to a section (e.g. a fender) of a vehicle. Where after, application of force to left end 58 of clamping means 54 is released allowing right end 60 and loop portion 62 to reassume their binding position, thereby maintaining adjustable cord 64 at a desired length for reliable Attachment to a vehicle.

Figure 4:
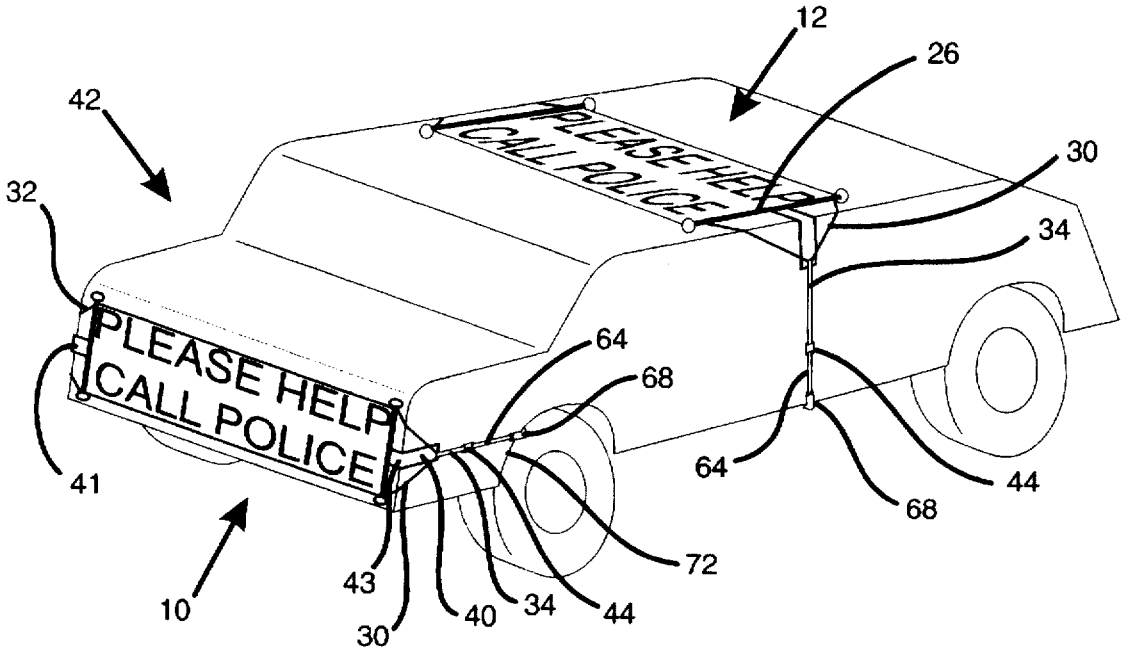
FIG. 4 is a perspective view showing the assistance summoning device attached to both a rear of a vehicle and to a top of a vehicle.
Figure 6:
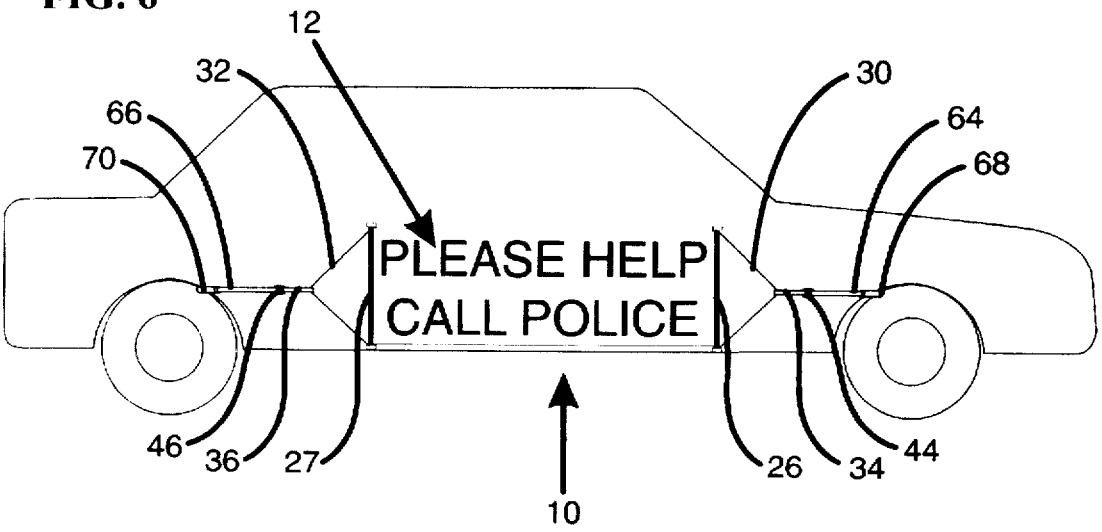
FIG. 6 is a perspective view showing the assistance summoning device attached to a side of a vehicle.

FIGS. 4 and 6 illustrate other non-exhaustive methods of attaching assistance summoning device 10 to a front, rear, top, side, hood, trunk, and bottom of a vehicle. Even though a car 42 is illustrated, device 10 may be used with any number of vehicles such as, though not limited to, trucks, aircraft, motor-cycles, bicycles, ships, boats, rafts, and campers. Device 10 may also be held by hand, attached to rocks, trees, the ground, and even buildings during natural disasters. Referring to FIG. 4, and more particularly to the device 10 attached to a rear of car 42, wherein hook mechanism 68 is attached to an edge of a fender 72. Adjustable cord 64 is extended to a desired length by using adjusting means 44, as described above, to allow elastic band section 30 to reach end portion 40 of a bumper 43. Banner material 12 is then unfurled and elastic band section 32 is extended over end portion 41 of bumper 43. Although not illustrated in FIG. 5, hook mechanism 70 is attached to the other side of the car 42 in a similar fashion as hook mechanism 68. Adjustable cords 64 and 66 may now be manipulated, as described above, to securely and reliably maintain device 10 in a taut position.

Figure 7:
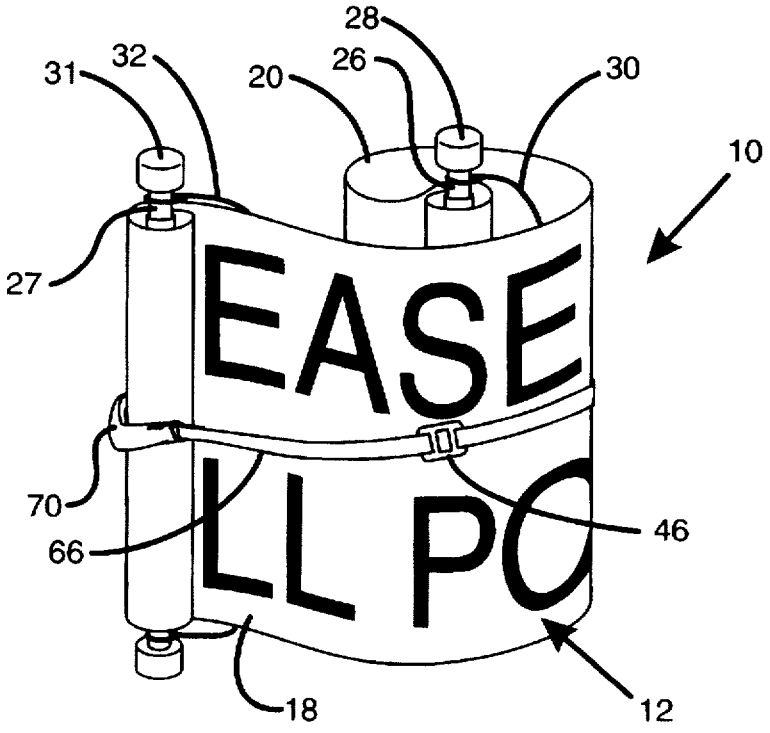
FIG. 7 is a perspective view showing the assistance summoning device in a portable and a storage phase.

Referring now to FIG. 7, an illustration is provided for device 10 in a storage and portable phase. Material 12 may be rolled up beginning at either first edge 18 or second edge 20. In FIG. 7, the rolling begins at edge 20, whereby vertical member 26, elastic band section 30, cord 34, adjusting means 44, adjustable cord 64, and hook mechanism 68 are enclosed within rolled layers of material 12. When material 12 is completely rolled up, adjustable cord 66 is extended in the same direction and rolled around material 12. Hook mechanism 70 is then attached to vertical member 27 and the length of adjustable cord 66 is then manipulated by adjusting means 46, as described above, to maintain device 10 in a rolled up position.

While the invention herein disclosed has been described by means of a specific embodiment and application thereof, numerous modifications, and variations could be made thereto by those skilled in the art without departing from the spirit and scope of the present invention. Accordingly, the scope of the invention should be determined not by the embodiments illustrated, but by the appended claims and their legal equivalents.

What is claimed is:

1. A portable and easily attachable assistance summoning device that is removably attachable to required surfaces, comprising:

a flexible sheet of material having a planar surface to which a variety of messages may be removably attached thereto;

said sheet material further having a first edge and a second edge, said first edge and second edge having at least a pair of rigid support members;

at least a pair of bands, each said band being attached to respective opposing ends of each said rigid member;

at least a pair of cords, each said cord having a first end and a second end, whereby each said first end is attached to each said respective band;

at least a pair of adjusting means, each said adjusting means being attached to said respective second end of each said cord;

at least a pair of adjustable fibers, each said adjustable fiber being attached to said respective adjusting means at ends opposite to each said cord;

at least a pair of latching means each said latching means being connected to each said adjustable fiber;

whereby, said device is attached to any desirable surface in a variable, flexible, but secured manner to relay messages of assistance to passing individuals.

2. The invention of claim 1, wherein said flexible material is made from substances selected from the group consisting of at least polyethylene plastics, vinyl, nylon, nylon mesh, and cotton.

3. The invention of claim 1, wherein said flexible material is buoyant, whereby it is used both as a means to summon assistance and a floatation device by individuals involved in nautical accidents.

4. The invention of claim 1, wherein said variety of messages contain a removable attaching means, and are made of reflective materials to allow maximum visibility in inadequate luminous conditions.

5. The invention of claim 1, wherein said rigid members are made of materials selected from the group consisting of magnetic substances, plastics, metals, and wood.

6. The invention of claim 1, wherein said pair of bands are made of a durable elastic material.

7. The invention of claim 1, wherein said cords and said adjustable fibers are made of a rigid and durable material.

8. The invention of claim 1, wherein said adjusting means are made of a substantially inflexible and inflexible material selected from the group consisting of plastic, metal, and woods.

9. The invention of claim 1, wherein said adjusting means has a buckle portion containing a bar to which said second end of said cord attaches, comprising;

a middle portion continuing from said buckle portion, wherein said middle portion contains a manipulable clamping means thereon;

said clamping means having a left end and a right end, wherein said right end has a serrated edge;

a loop portion extending from said middle portion of said adjusting means, wherein said loop portion contains said adjustable fiber;

a spring biasing means disposed between said middle portion and said clamping means, whereby said spring biasing means causes removable force to be applied to said serrated edge of said right end, whereby said adjustable fiber is maintained in a fixed position between said serrated edge and said loop portion of said adjusting means.

10. The invention of claim 1, wherein said latching means' are made of materials selected from the group consisting of magnetic substances, plastics, metals, and wood.

11. The invention of claim 1, wherein said rigid members are magnetic and allow independent fixation of said flexible material to metallic surfaces.

12. The invention of claim 1, wherein said bands, said latching means, said magnetic rigid members allow independent and cooperative secure and reliable attachment of said flexible material to various surfaces of vehicles.

13. The invention of claim 1, wherein said device is easily stored by rolling up, whereby entanglement of said bands, said cords, and said fibers is prevented.

14. A portable, easily attachable and removable assistance summoning device that is attachable to a large number of surfaces, comprising:

a foldable material having a surface to which at least one message of assistance is removably attached;

said flexible material having a first left side and a second right side, each said side having at least one reinforcing members disposed thereon having a respective ends;

at least a pair of respective bands, each said band being attached to said respective ends of said reinforcing members;

at least a pair of adjustable cords, each said cord having a respective first end and a respective second end, whereby each said respective first end is attached to each said respective band;

at least a pair of latching members, each said latching member being attached to a respective second end of said respective adjustable cord;

at least a pair of adjusting means, each said adjusting means disposed on each said respective adjustable cord between each said respective band and each said respective latching member;

whereby, said device is manipulable into a large variety of lengths to allow attachment to a variety of objects.

15. The invention of claim 14, wherein said foldable material is made of a mesh material that is water resistant and wind resistant, whereby said material allows rain and wind to pass therethrough to ensure reliable attachment to required surfaces in adverse weather conditions.

16. The invention of claim 14, wherein said message is made of a luminous reflective material and is removably attached to said foldable material through a hook and loop mechanism.

17. The invention of claim 14, wherein said reinforcing members are made of magnetic material to allow binding to metallic surfaces.

18. The invention of claim 14, wherein said device is light weight and buoyant.

19. The invention of claim 14, further comprising a storage case, wherein said device may be rolled up and stored.

* * * * *